US005147507A

United States Patent [19]

Gill

[11] Patent Number: 5,147,507

[45] Date of Patent: Sep. 15, 1992

[54] CATIONIC POLYMER-MODIFIED FILLER MATERIAL, PROCESS FOR ITS PREPARTION AND METHOD OF ITS USE IN PAPERMAKING

[75] Inventor: Robert A. Gill, Bethlehem, Pa.

[73] Assignee: Pfizer Inc., New York, N.Y.

[21] Appl. No.: 628,318

[22] Filed: Dec. 17, 1990

Related U.S. Application Data

[62] Division of Ser. No. 490,909, Mar. 8, 1990.

[51] Int. Cl.[5] ..... D21H 17/69

[52] U.S. Cl. ..... 162/158; 162/164.3; 162/164.6; 162/181.1; 162/181.2; 162/183

[58] Field of Search ..... 162/164.3, 164.6, 181.1, 162/181.2, 183, 158

[56] References Cited

U.S. PATENT DOCUMENTS

| | | | |
|---|---|---|---|
| 2,865,743 | 12/1958 | Weisgerber | 162/158 |
| 2,992,964 | 7/1961 | Werner et al. | 162/158 |
| 3,252,852 | 5/1966 | lagally | 162/181.1 |
| 3,922,243 | 11/1975 | Aldrich et al. | 162/164.3 |
| 4,295,933 | 10/1981 | Smith | 162/181.2 |
| 4,376,078 | 3/1983 | Topfl | 162/164.6 |
| 4,610,801 | 9/1986 | Matthews et al. | 162/181.2 |

FOREIGN PATENT DOCUMENTS

| | | | |
|---|---|---|---|
| 2516097 | 11/1975 | Fed. Rep. of Germany | 162/181.2 |
| 59-66599 | 4/1984 | Japan | 162/181.2 |
| 60-119299 | 6/1985 | Japan | 162/181.2 |

*Primary Examiner*—Peter Chin

*Attorney, Agent, or Firm*—Peter C. Richardson; Lawrence C. Akers; Howard R. Jaeger

[57] ABSTRACT

Material, such as natural ground and precipitated calcium carbonate, when modified by surface-treatment with a cationic polymer, has been discovered to be highly effective as a filler material in the making of paper. Utilization of this type of filler material greatly improves the papermaking process by reducing the usage of wet end sizing agent, improving opacity, improving filler retention in the furnish, and causing better drainage on the papermachine, all of which result in the production of a high quality paper having excellent opacity and tensile strength characteristics. The nature of the polymer-modified filler material, the process for its preparation and the method of its use in papermaking are disclosed.

2 Claims, 11 Drawing Sheets

CATIONIC POLYMER-MODIFIED FILLER MATERIAL, PROCESS FOR ITS PREPARTION AND METHOD OF ITS USE IN PAPERMAKING

This is a division of application Ser. No. 490,909, filed on Mar. 8, 1990.

FIELD OF THE INVENTION

This invention broadly relates to the field of surface treated inorganic compounds. More particularly, the invention relates to the provision of compositions suitable for use as a papermaking filler material wherein an inorganic base filler material is surface treated with a substance which enhances the performance of the filler in the papermaking process. The invention also relates to a method for improving the papermaking process, especially by reducing the requirement for sizing material and for improving the characteristics of paper produced according to the process.

BACKGROUND OF THE INVENTION

Adequate internal sizing of alkaline papers is an important issue for most papermakers. Early development of cellulose reactive sizing agents resulted in poor control of sizing with excessive amounts of sizing agent used, resulting in increased wet-end deposits, press picking, and in coefficient of friction problems with the paper surface. Problems still occur, mainly due to the overuse of sizing materials. The problems are caused by high surface area materials (e.g., filler and fines) found in the wet-end, which adsorb the size and render it ineffective.

The purpose of internal sizing is to impart resistance to liquid penetration to the sheet. Internal sizing, along with sheet porosity (which is controlled at the size press), controls ink penetration in printing and writing papers, along with binder migration in coating basestock. The sizing of alkaline papers with cellulose reactive sizing agents or "synthetic sizes" has been established for more than 30 years. Two synthetic sizes presently in commercial use, alkyl ketene dimer (AKD) and alkenyl succinic anhydride (ASA), impart sizing to the sheet by means of a chemical reaction (covalent bonding) with the hydroxyl groups of cellulose fiber.

All commonly used untreated fillers (e.g., clay, titanium dioxide, calcium carbonate) are known to have a detrimental effect on sizing. Studies of alkaline papers filled with various types of calcium carbonate have revealed strong inverse correlations between filler specific surface area and internal sizing values in the sheet measured by the Hercules size test (HST). In circumstances where increasing the filler content would be advantageous, associated sizing problems have occurred affecting sheet quality, machine performance, and runnability.

SUMMARY OF THE INVENTION

Specially modified precipitated calcium carbonate (PCC) fillers, which can be synthesized at an on-site PCC plant, have been developed to make the sizing of filled sheets more economical and efficient. Laboratory results have shown that by using a chemically modified PCC filler, which has been surface treated with a cationic polymer, the amount of sizing agent can be reduced by one-half while improving other properties as well.

It has been discovered that the addition of certain cationic resin materials to papermaking filler materials such as calcium carbonate, either ground natural calcium carbonate from limestone, or precipitated, greatly enhances the performance of the filler material and results, in a paper requiring the addition of substantially less wet end sizing agent, and having excellent opacity and tensile strength properties.

DETAILED DESCRIPTION OF THE INVENTION

Figure 1:
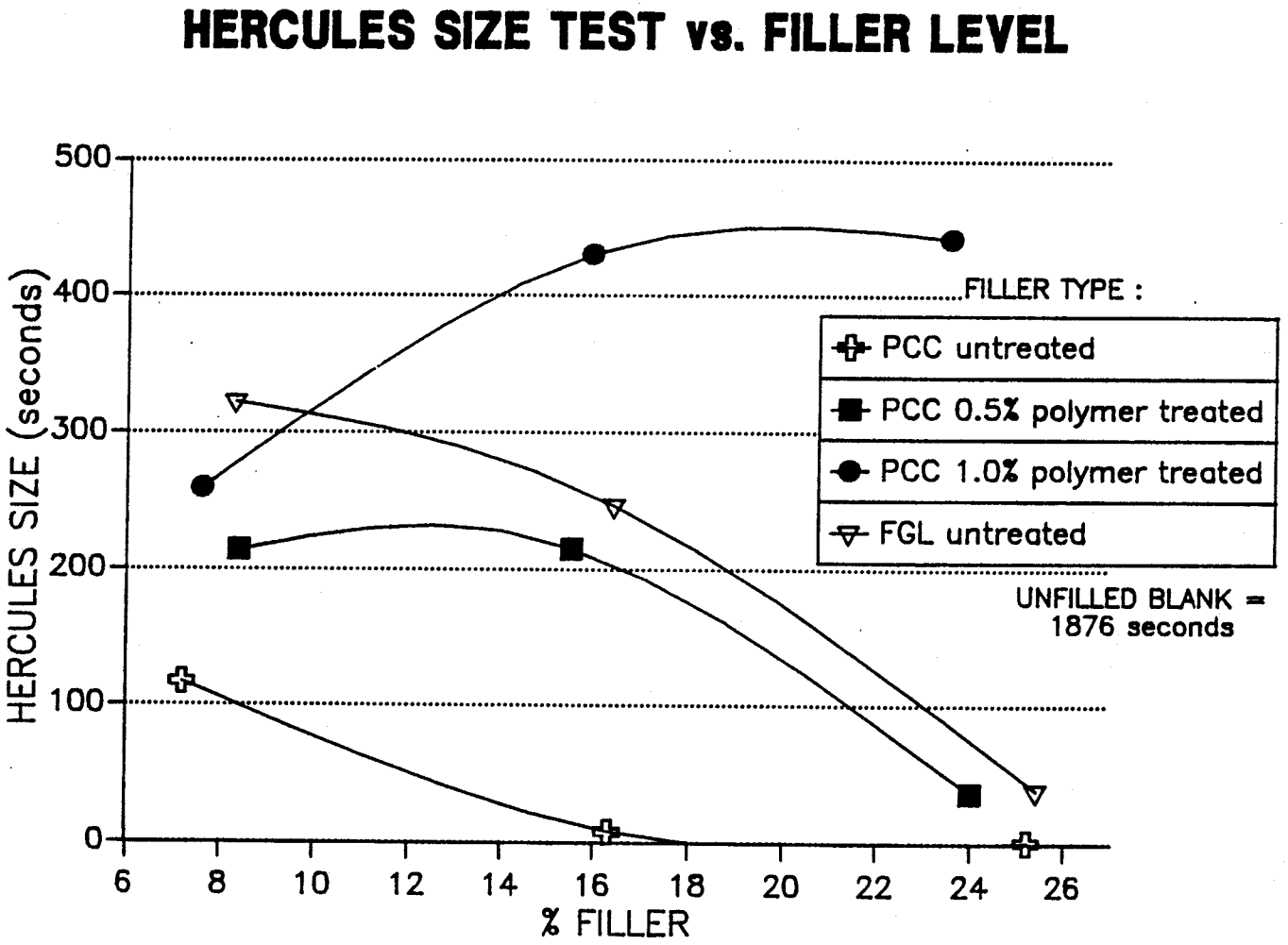
FIG. 1 is a plot of Hercules size measurement versus filler content for handsheets containing modified and unmodified fillers.

The cationic polymers found to be most effective for surface treating the papermaking filler materials are dimers of the general formula:

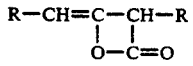

where R is a hydrocarbon group selected from the group consisting of alkyl with at least 8 carbon atoms, cycloalkyl with at least 6 carbon atoms, aryl, aralkyl and alkaryl. Specific dimers are octyl-, decyl-, dodecyl-, tetradecyl-, hexadecyl-, octadecyl-, eikosyl-, dokosyl-, tetrakosyl-, phenyl-, benzyl-beta-naphthyl-, and cyclohexyl- dimer. Other utilizable dimers are dimers produced from mining acids, naphthenic acid, delta-9,10-decylenic acid, delta-9,10 dodecylenic acid, palmitoline acid, olein acid, ricine olein acid, linoleate, linoleic acid, and olestearic acid, as well as dimers manufactured from natural fatty acid mixtures, such as are obtained from cocoanut oil, babassu oil, palm seed oil, palm oil, olive oil, peanut oil, rape seed oil, beef suet and lard, and mixtures of the above.

The polymer is made cationic as a result of treating the dimer with a polyamino-amide and/or polyamine polymer reacted with an epoxidized halohydrin compound, such as epichlorohydrin, thereby forming tertiary and quaternary amine groups on the dimer surface. It is preferred that the cationic charge on the dimer be derived primarily from quaternary amine groups. A polymer material of this type is manufactured by and is commercially available from Hercules, Inc., Wilmington, Del., under the tradename Hercon.

It has been discovered that the use of from about 0.1% to about 10.0% by weight of the cationic polymer material on a filler significantly enhances filler performance in terms of a reduction in the requirement for the addition of wet end sizing agent and an improvement in the optical and physical properties, particularly opacity, Z-directional filler distribution and tensile strength, of the resulting paper in which the filler is utilized.

For the case of utilizing clay as a filler material, it has been discovered that surface treatment of the filler with from about 1.0 to about 2.0 weight percent of a cationic polymer material of the aforesaid type is effective in producing a filler clay having a substantially reduced sizing demand.

It has also been discovered that surface treatment of a PCC filler material with from about 0.25 to about 2.0 weight percent of a cationic polymer material of the aforesaid type is effective in producing a filler having a substantially reduced sizing demand.

Other filler materials, such as titanium dioxide, talc and silica/silicate pigments, which if used untreated have a detrimental effect on sizing, are utilizable when treated with a cationic polymer material of the aforesaid type according to the present invention.

For all types of fillers, it has been discovered that the amount of cationic polymer required to be added to the filler material-containing slurry is directly correlated with the surface area of the filler material.

EXAMPLES

The nature and scope of the present invention may be more fully understood in view of the following non-limiting examples, which demonstrate the effectiveness of cationic polymer modified filler materials.

EXAMPLE 1

Preparation and Comparative Testing of Handsheets Containing Modified and Unmodified Fillers Comparative Formax (Noble and Wood) handsheets (60 g/m$^2$ or 40 lbs./3300 ft$^2$) were prepared from a furnish consisting of 75% bleached hardwood and 25% bleached softwood Kraft pulps beaten to 400 Canadian Standard Freeness (CSF) at pH 7.0 in distilled water. A high molecular weight, medium charge density, cationic polyacrylamide (PAM) retention aid was used at, 0.05%. Synthetic sizing agents (AKD or ASA) were added at levels from 0.10% to 0.30%. Several fillers were used, including various polymer-modified PCC fillers to test the effect of the polymer treatment against unmodified PCC and fine ground limestone (FGL). The fillers were added to the furnish at 20% solids to achieve 8%, 16%, 24% and 40% filler in the finished sheets. In addition, a blank, containing no filler was prepared and tested. Distilled water was used throughout the handsheet process. The sheets were conditioned at 50% RH and 23° C. and tested for grammage, percent filler, HST, Cobb size, opacity, brightness, caliper, tensile, and porosity. Scattering coefficients were determined using the appropriate reflectance values and Kubelka-Munk equations. Elemental mapping of the filler distribution in the sheet, both in the XY plane and in the Z-directional plane, was performed using a scanning electron microscope (SEM) with elemental analysis capabilities.

Figure 2:
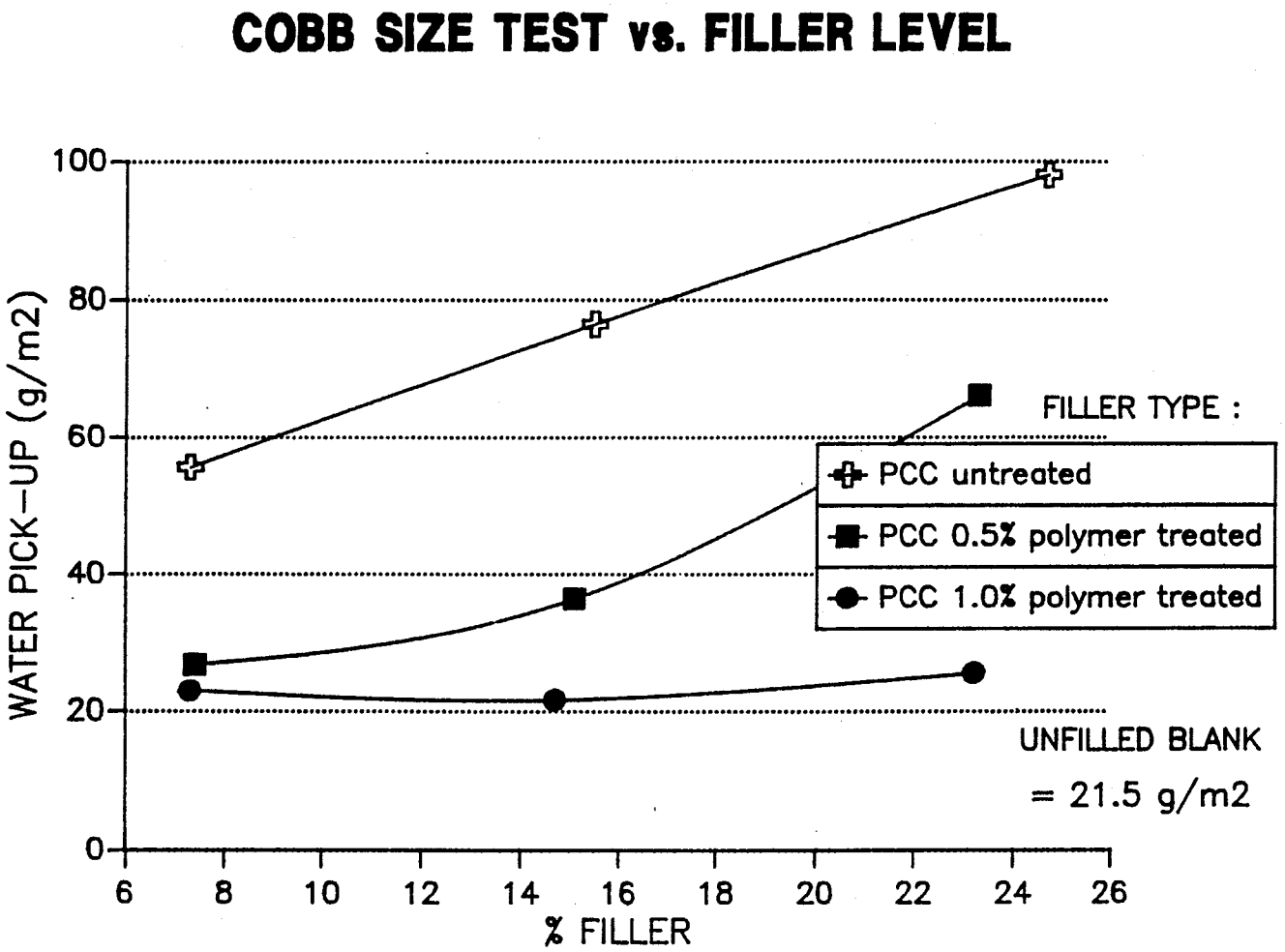
FIG. 2 is a plot of water pick-up as measured by the Cobb size test versus filler content for handsheets containing modified and unmodified fillers.
Figure 3:
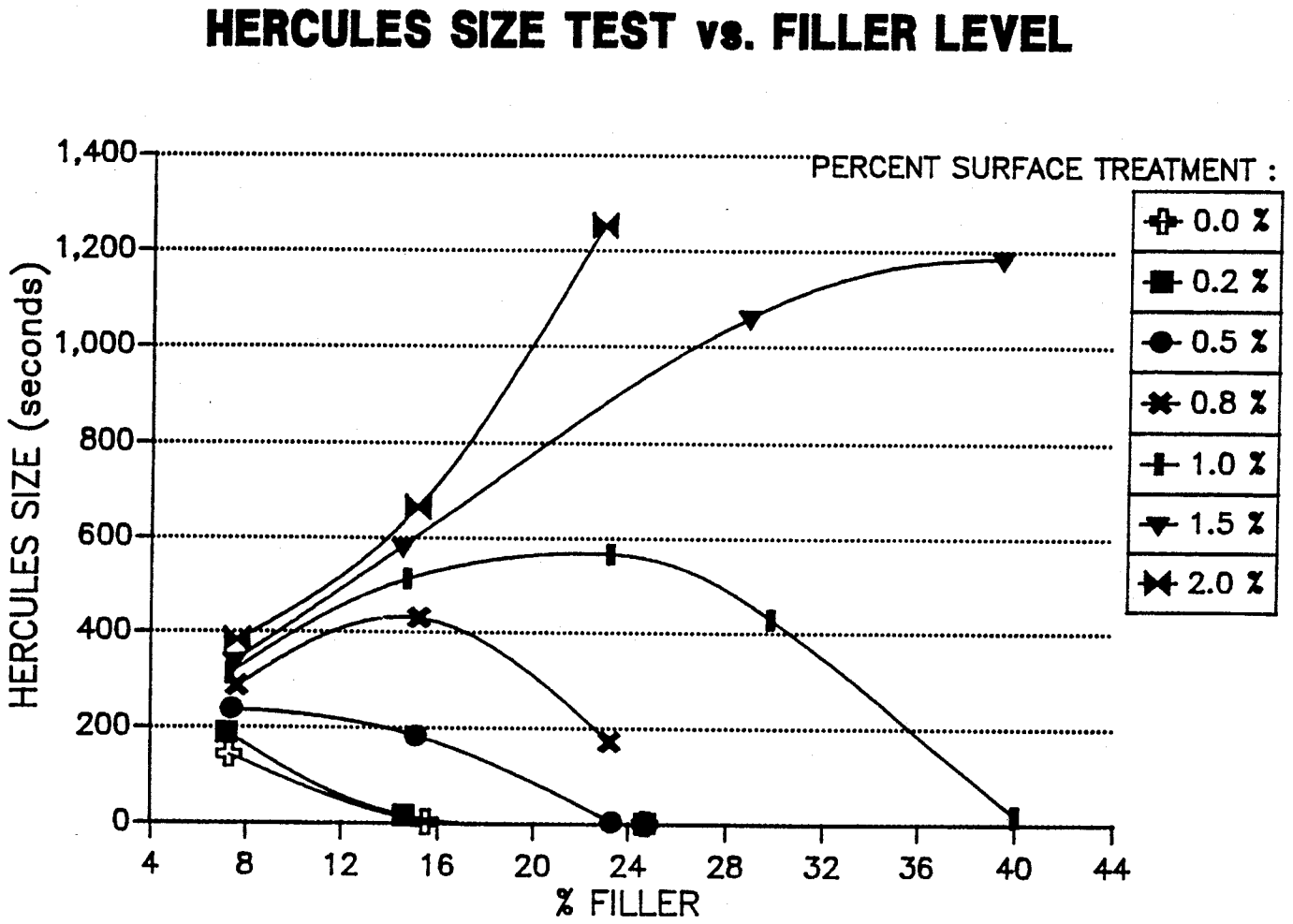
FIG. 3 is a plot of Hercules size measurement versus filler content for handsheets containing modified filler at various levels of polymer treatment.
Figure 4:
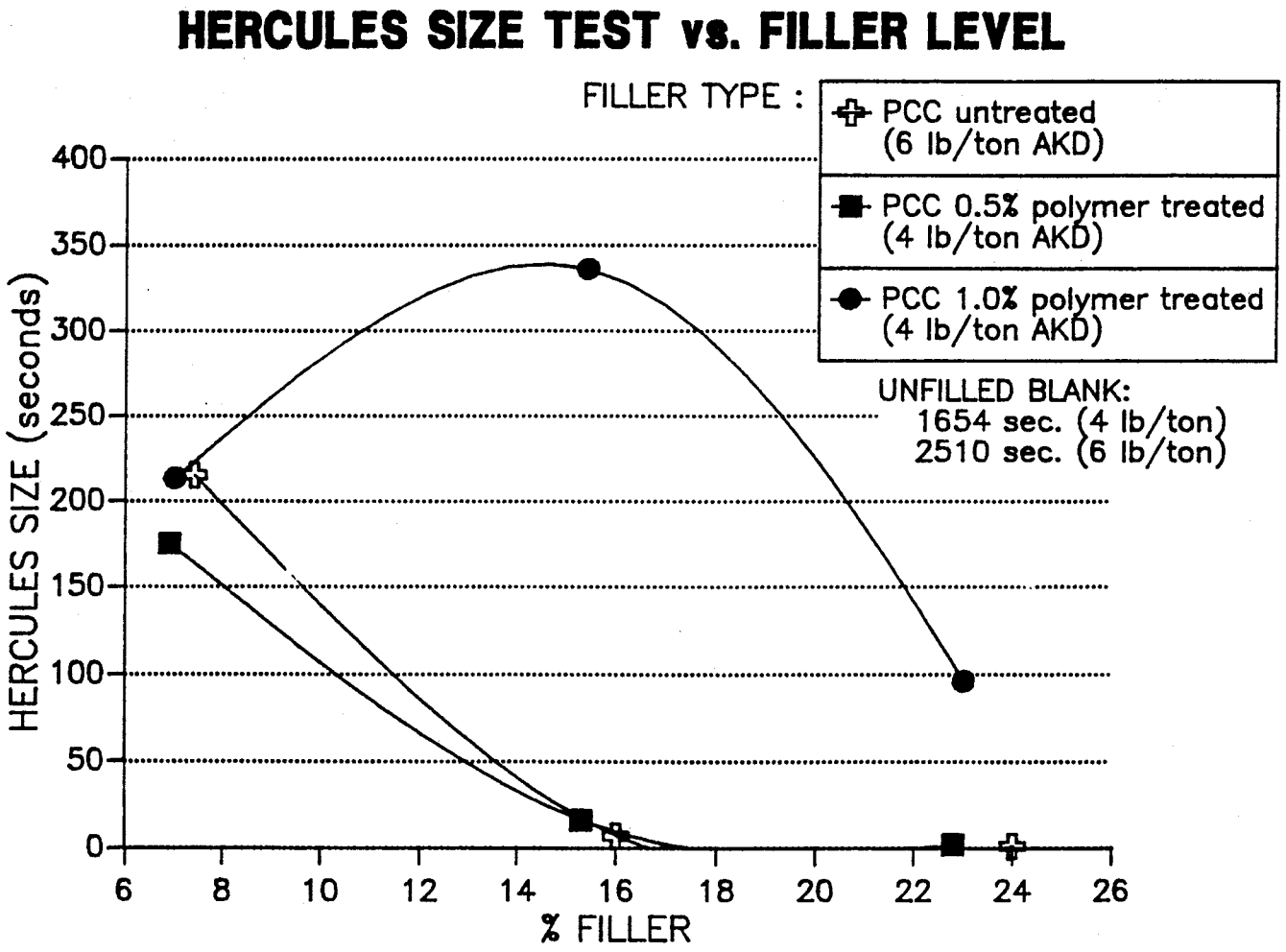
FIG. 4 is a plot of Hercules size measurement versus filler content for handsheets containing modified and unmodified fillers at different sizing levels.

Sizing values (HST and Cobb) for sheets filled with the modified PCC fillers were significantly improved, with higher levels of polymer on the PCC providing significantly better sizing at all loading levels greater than 10% versus a low sizing demand filler (e.g., FGL) (FIGS. 1, 2, and 3). Comparable sheets can be made using one-third less sizing agent when a 0.5 percent by weight cationic polymer-treated PCC filler was used (FIG. 4), and as the graph reveals, even less sizing agent was needed using a 1.0 percent by weight cationic polymer-treated PCC filler. Table I also shows the efficiency of polymer treatment of the filler.

Figure 5:
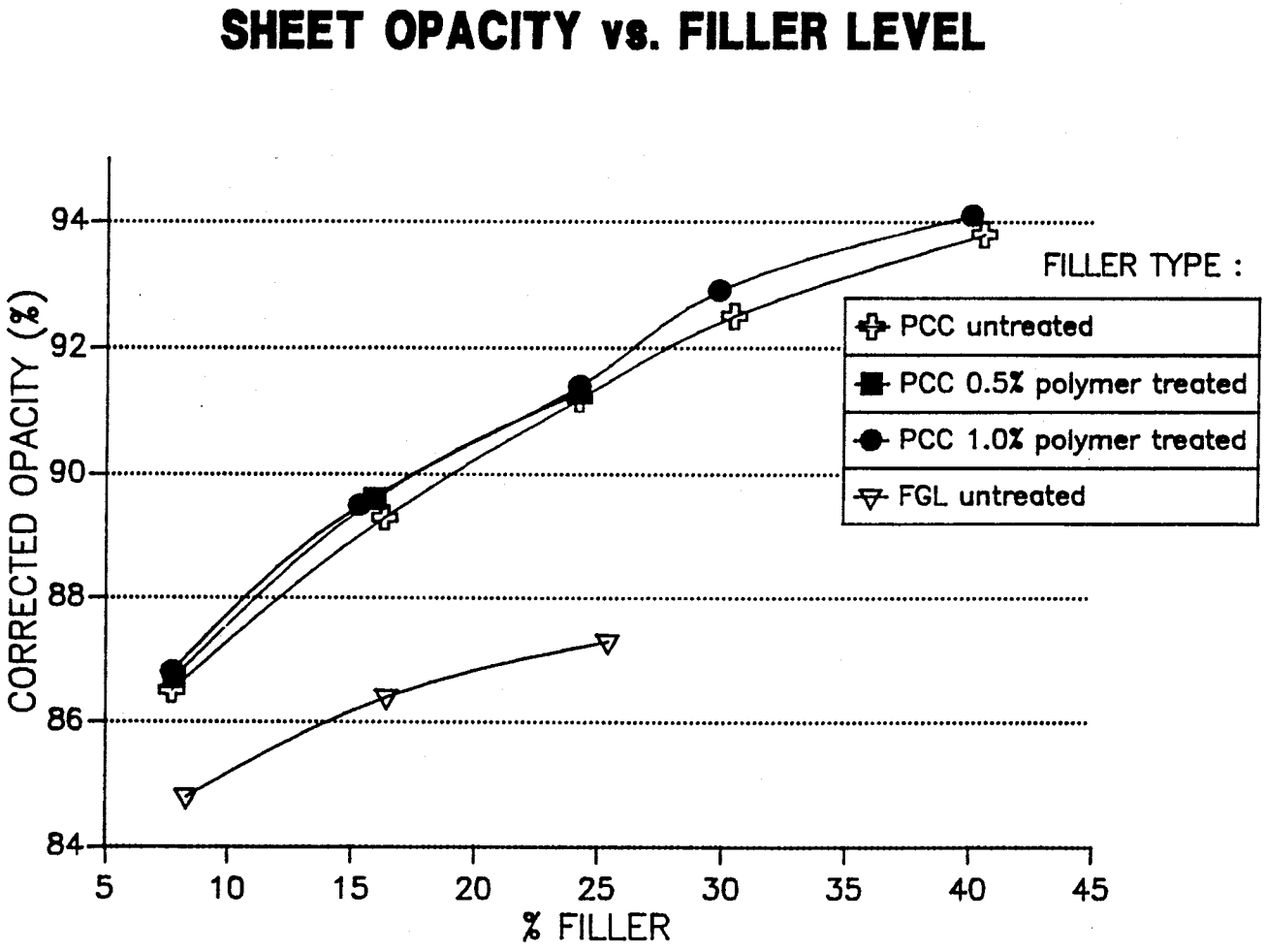
FIG. 5 is a plot of sheet opacity versus filler content for handsheets containing modified and unmodified fillers.
Figure 6:
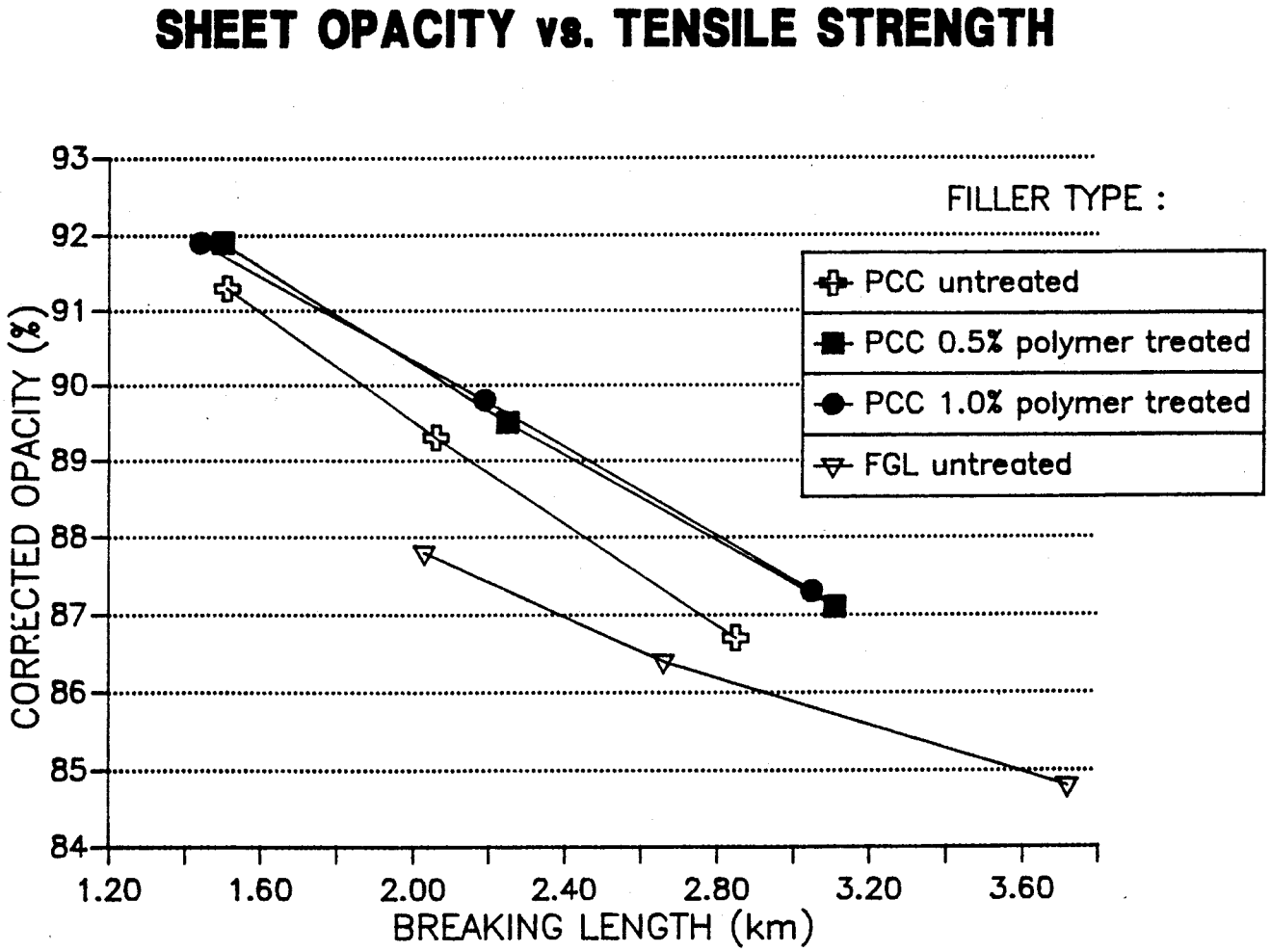
FIG. 6 is a plot of sheet opacity versus sheet tensile strength for handsheets containing modified and unmodified fillers.
Figure 7:
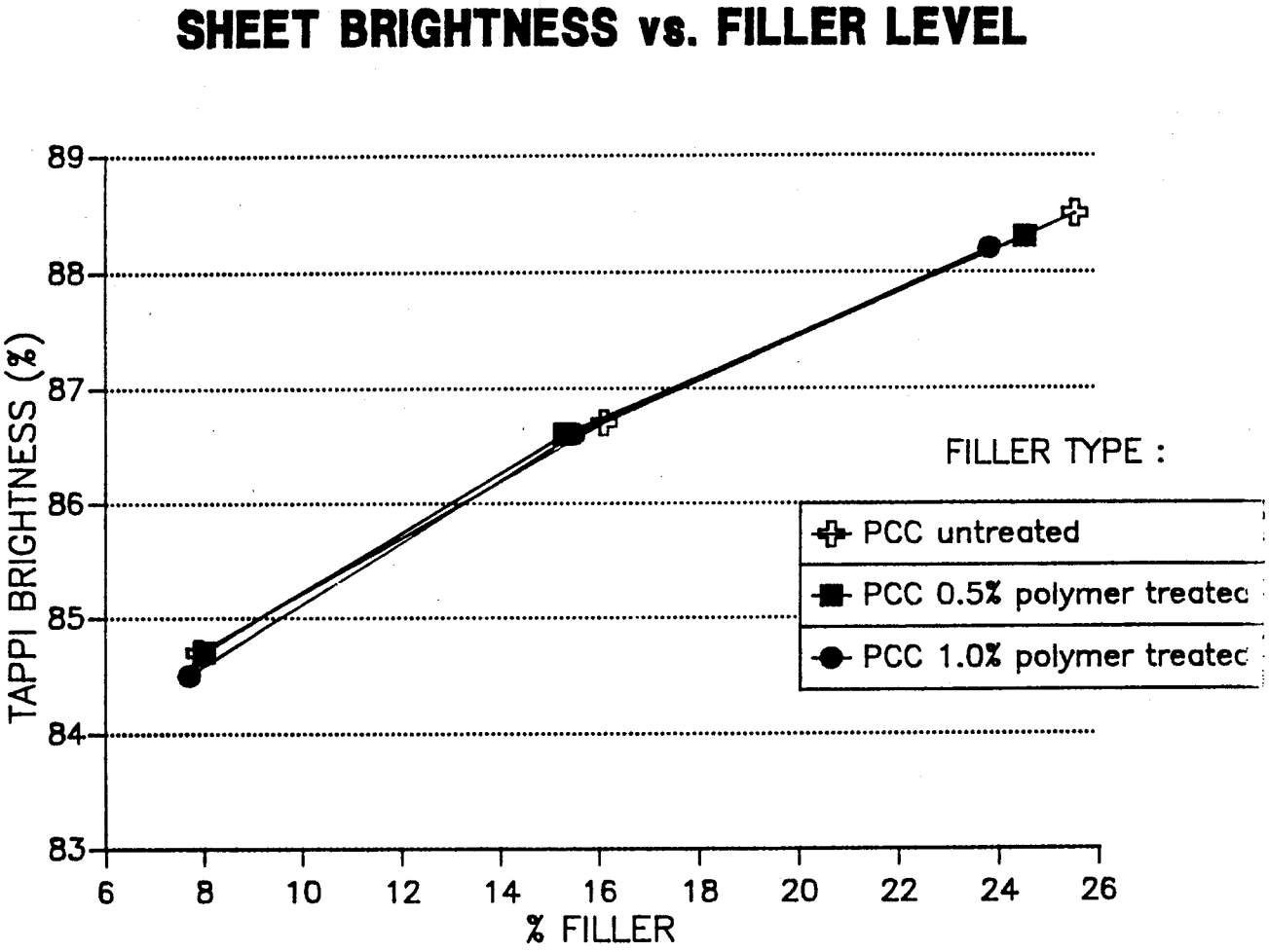
FIG. 7 is a plot of sheet brightness versus filler content for handsheets containing modified and unmodified fillers.

A secondary benefit derived from the modified fillers was an increase of one-half point in opacity without a subsequent loss in tensile strength or sheet brightness (FIGS. 5, 6, and 7). The increased opacity without loss of strength or brightness appears to be predominantly due to the substantial increase in the cationic charge of the modified filler particles. Increasing the cationic charge on the particles makes them adsorb more uniformly on the fiber surface and less between fiber crossings. Scanning electron micrographs revealed better distribution of the filler in the sheet for the modified PCC fillers which supports improved optical performance. Table II shows the relationship between the filler's specific surface area and polymer treatment level on sizing values. At higher surface area, more polymer is needed to cover the surface and provide improved sizing. Unexpectedly, as the filler level is increased in the sheet, the sizing values continue to rise for all but the highest surface area filler. This indicates that by the method of treatment of this invention, increased sizing is maintainable through the use of higher filler levels in the sheet. This condition cannot be achieved by the use of untreated fillers.

EXAMPLE 2

Evaluation of Modified PCC Fillers for Retention and Drainage

A vacuum drainage jar apparatus was used to measure the retention and drainage characteristics of the fillers under conditions similar to an actual high-speed papermachine. The furnish was the same as used in Example 1 with the retention aid level evaluated at 0.05%. The fillers were added so that a content of 16%±1.0% would be retained in the final pad. The stock (0.5% consistency) was agitated in a three vane jar at 750 rpm. Automatic control placed the contents of the jar under a vacuum of 10 kPa during initial drainage followed by 5 seconds of high vacuum (50 kPa). The pad which formed was weighed and then dried and reweighed to yield percent sheet dryness values (these numbers predict the ease at which water is removed from the sheet). Percent filler retention was calculated from the amount of calcium carbonate in the fiber pad via X-ray fluorescence and the known amount added to the stock.

Improved papermachine runnability can be measured in many ways. Improved drainage on the wire along with increased sheet dryness off the couch provides the papermaker with the opportunity to increase machine speed (increase production rate) and/or decrease steam consumption at the dryers (increased profitability). Improved filler retention without the need to use excessive amounts of retention aid enhances sheet quality which includes formation. This also leads to better runnability and economics from a cleaner wet end system. Retention and drainage results, shown in Table III, using a vacuum drainage jar revealed improved first pass filler retention for the modified PCC fillers. Sheet dryness values were also improved over the untreated PCC filler, indicating better drainage. The experiments were conducted under precise and well-controlled conditions in the laboratory, however these results are transferable to a papermachine leading to better wet end control with improved runnability, as is shown in Examples 3 and 4, following.

EXAMPLE 3

Comparative Testing of Furnishes Incorporating Both Modified and Unmodified Fillers on Actual Pilot Papermachine A pilot machine run was conducted utilizing a pilot scale papermachine. A 60 g/m$^2$ (40 lbs./3300 ft$^2$) sheet was produced using the same furnish composition as in Examples 1 and 2. The same cationic retention aid was utilized at 0.0125% and an AKD sizing agent was added at 0.15%. Various calcium carbonate fillers (i.e., untreated commercial PCC, untreated commercial FGL, 0.5 and 1.0 percent by weight cationic polymer-modified PCC's) were added to achieve levels of 8%, 16%, and 24% filler in the sheet.

The paper was tested for the same properties as in Example 1.

The fillers were characterized with respect to particle size by gravity sedimentation analysis using a Micromeritics Sedigraph 5000D. Specific surface area was determined by the use of BET nitrogen adsorption analysis. Dry brightness was measured using a Hunter LabScan. Particle charge (zeta potential) was determined using doppler laser light scattering technique from a Coulter DELSA 440. Filler properties are listed in Table IV.

Figure 8:
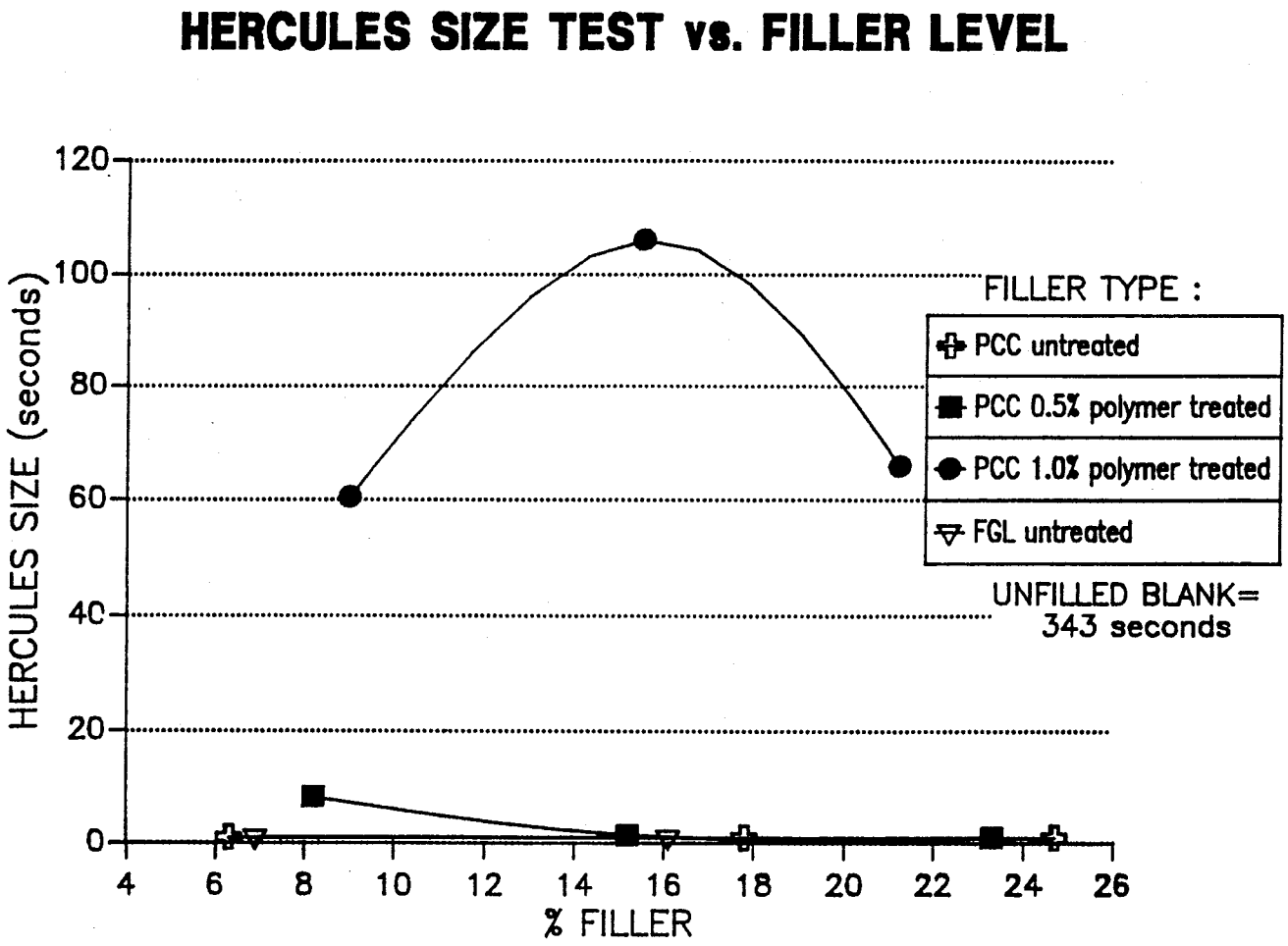
FIG. 8 is a plot of Hercules size measurement versus filler content for sheets containing modified and unmodified fillers made on a pilot papermachine.
Figure 9:
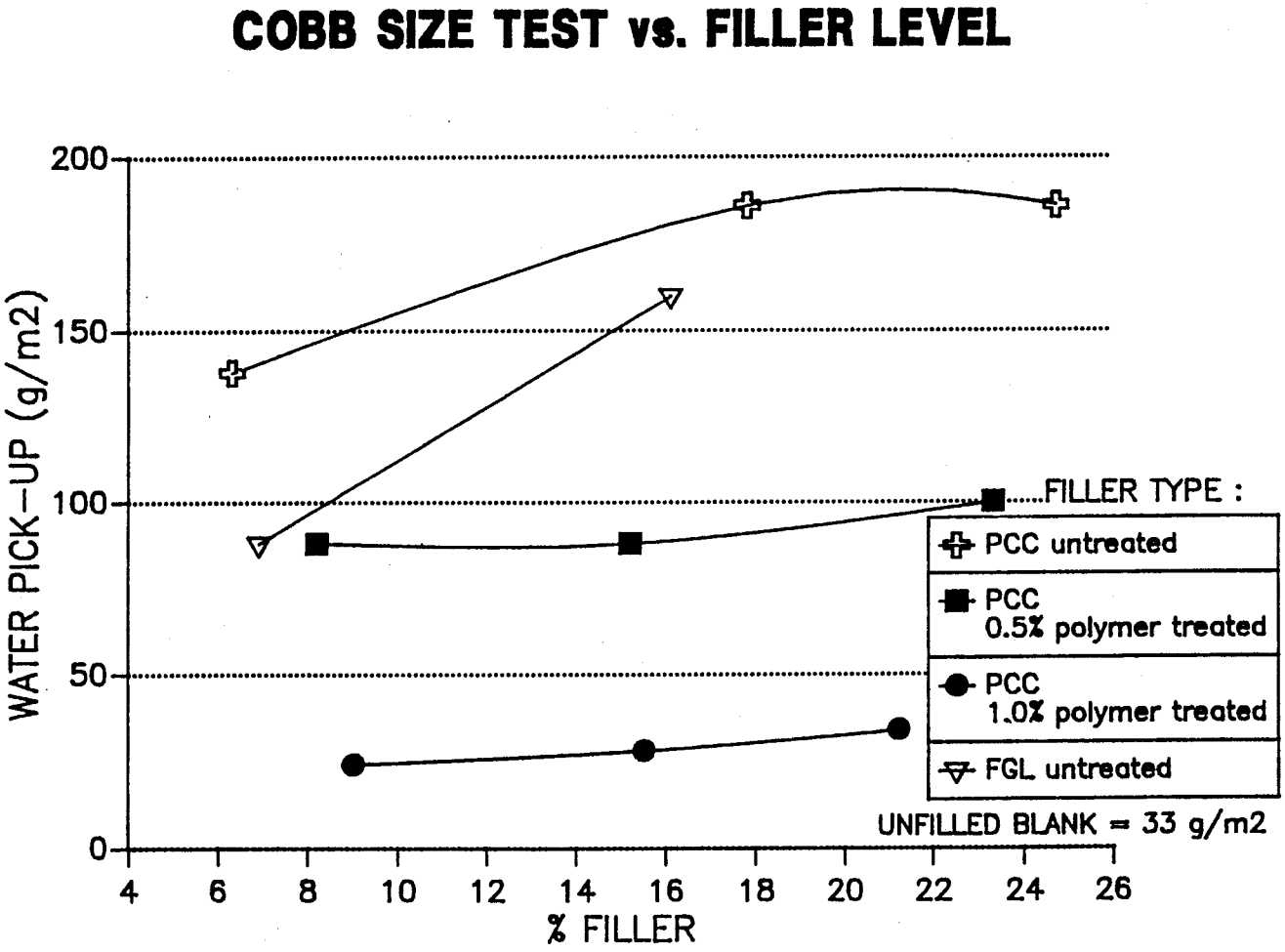
FIG. 9 is a plot of water pick-up as measured by the Cobb size test versus filler content for sheets containing modified and unmodified fillers made on a pilot papermachine.

Results from the pilot papermachine corroborated the results from the handsheet work. Sizing values shown in FIGS. 8 and 9 reveal the improved sizing performance for the modified PCC fillers. Since the Hercules size test (HST) was not sensitive enough to distinguish between sizing differences at the low end, the Cobb test was used to better ascertain their performance. The Cobb sizing test results show the characteristic increase in water pick-up for the commercial fillers (i.e., FGL and PCC) with increasing filler loading. This increase is virtually eliminated when utilizing the modified PCC fillers. In addition, 1.0 percent by weight cationic polymer-modified PCC filler provides essentially the same resistance to water pick-up at all filler loading levels as the unfilled sheet using the equivalent amount of sizing agent. Print quality evaluated through microscopic analysis of half-tone dots shows a marked improvement in ink hold-out in sheets using the modified PCC fillers.

Figure 10:
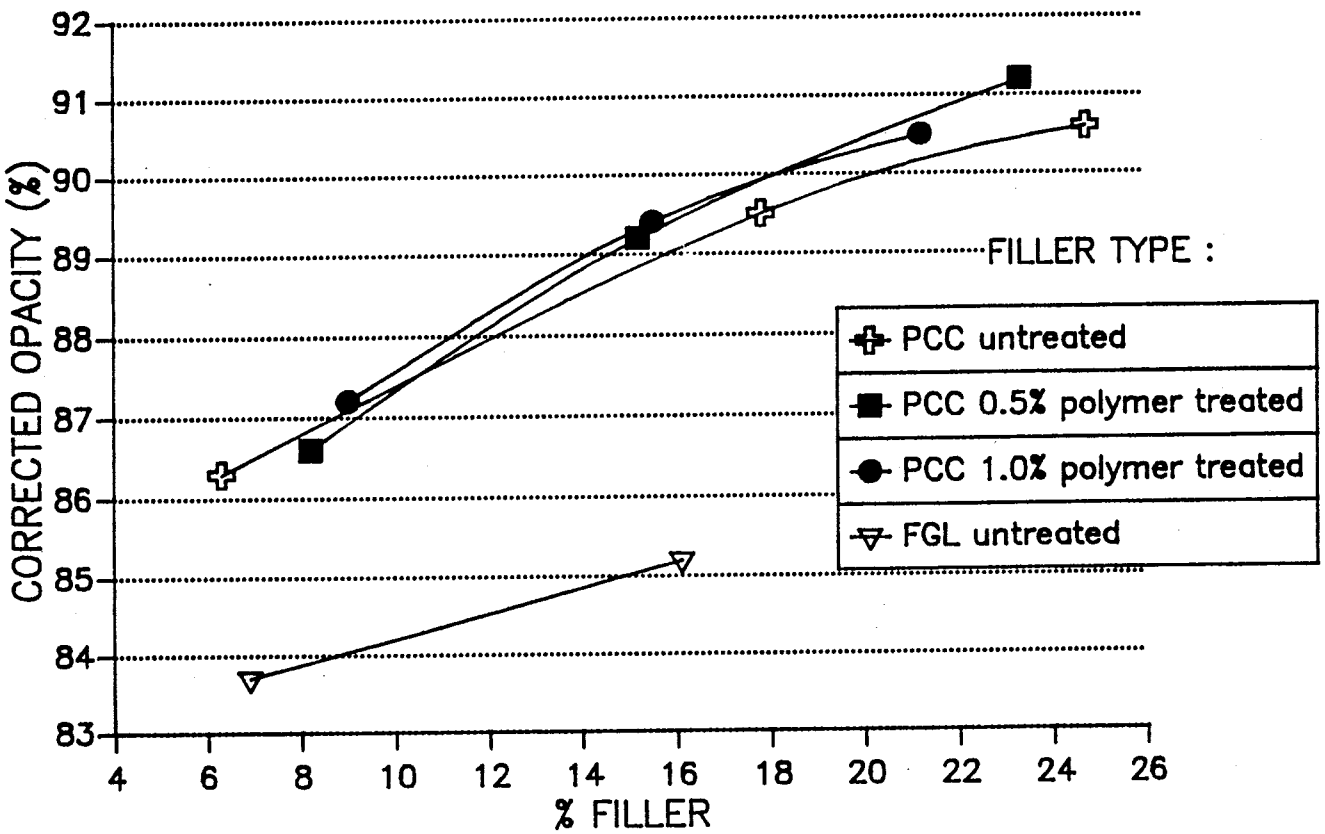
FIG. 10 is a plot of corrected sheet opacity versus filler content for sheets containing modified and ummodified fillers made on a pilot papermachine.
Figure 11:
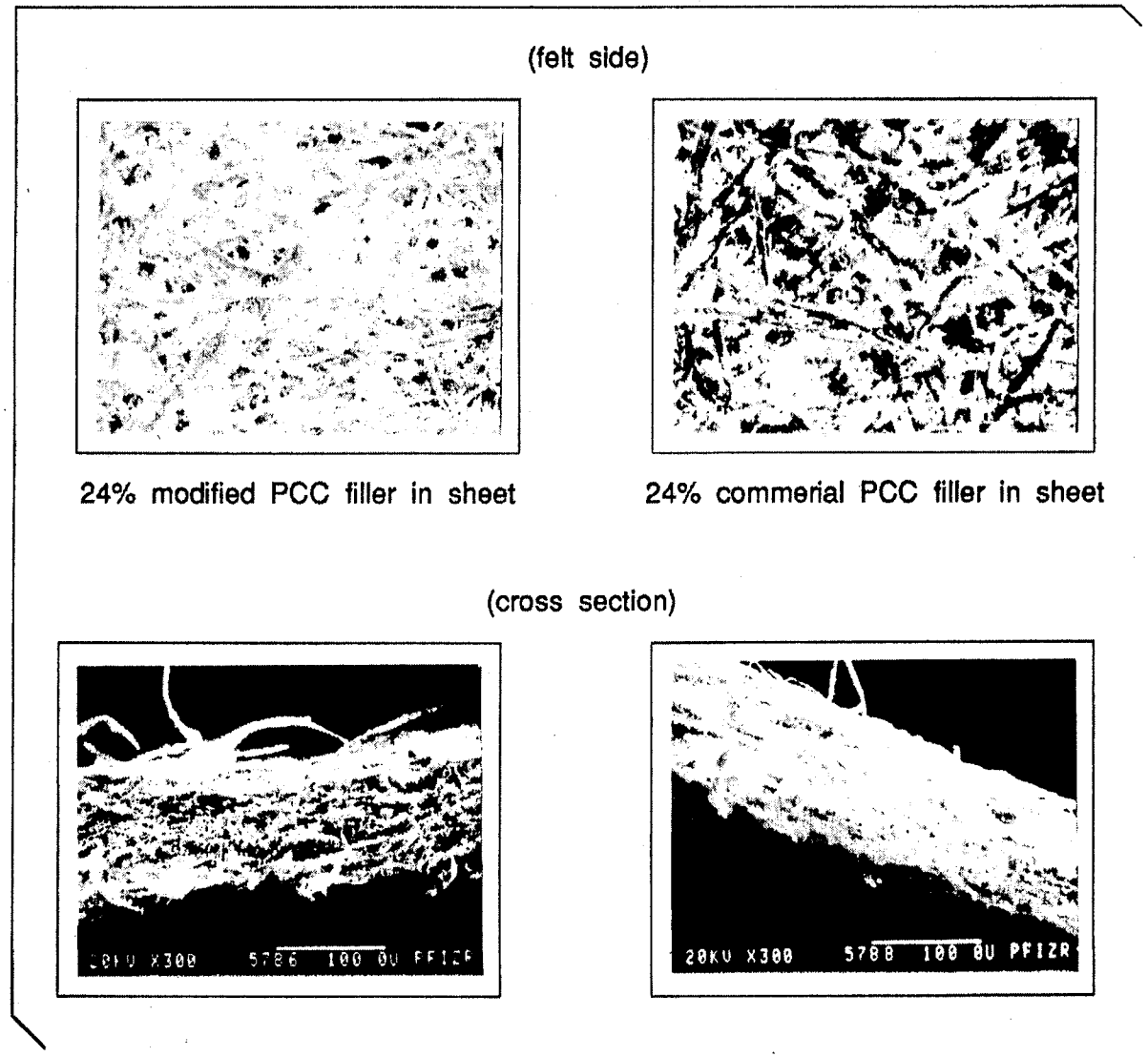
FIG. 11 shows comparative microscopic photographs illustrating distribution of filler material for sheets containing modified and unmodified fillers made on a pilot papermachine.

There was a one-half point improvement in opacity, corroborating laboratory results (FIG. 10). Calcium elemental mapping of the filler distribution in the sheet (FIG. 11) revealed better distribution, especially in the Z-directional plane, for the modified PCC fillers.

EXAMPLE 4

Comparative Testing of Furnishes Incorporating Both Modified and Unmodified Fillers on a Production Papermachine A mill trial was conducted utilizing a Fourdrinier papermachine running at 2000 fpm. A 60 g/m$^2$ (40 lbs/3300 ft$^2$) high opacity sheet was run with and without a modified PCC filler as part of the furnish composition. The modified PCC filler was treated with 1.5 percent by weight of cationic polymer. An anionic retention aid was utilized along with an ASA sizing agent. Both additives were held constant throughout the trial. Handbox and white-water tray samples were obtained throughout the trial and analyzed for first pass filler retention and total retention. These results are shown in Table V. Significant improvement in both filler retention and total retention were realized. Z-directional distribution of the modified filler through the sheet was also greatly improved. Better distribution of the filler means less two-sidedness, better dimensional stability and better printability of the paper with less associated whitening and dusting (Table V). Paper samples were tested and revealed a 263% improvement in sizing (i.e. 40 sec. vs. 11 sec.) and equivalent opacity with 4.5% less PCC (i.e. 15.0% vs. 15.7%) and 25% less $TiO_2$ (0.6% vs 0.8%). A 9% improvement in tensile strength was also realized. These results are shown in Table VI. Loss of sizing, referred to as "fugitive sizing", was evaluated after 5 weeks (35 days). The results are shown in Table VII. The samples showed a minimum loss of sizing compared to typical commercially filled sheets. The surface coefficient of friction of the sheets was also evaluated. The surface coefficient of friction of the sheets is an important measure of the runnability of the paper through high-speed reprographic equipment. The results of this evaluation are shown in Table VIII. The polymer-modified PCC-filled sheets showed a better coefficient of friction of the sheet surface than the unmodified sheets.

TABLE I

Improvements in Paper Properties by Surface Treatment of Filler with AKD Resin (16% filler in sheet)

| % AKD* added to pulp | % AKD* added to filler | Sheet Opacity (%) | Brightness (%) | HST (seconds) |
|---|---|---|---|---|
| 0.4% | 0 | 87.7 | 84.3 | 158 |
| 0 | 0.4% | 88.5 | 85.7 | 335 |
| 0.6% | 0 | 87.9 | 83.9 | 361 |
| 0 | 0.6% | 88.9 | 84.9 | 434 |

TABLE II

Effect of Surface Area and Polymer Treatment Level on Sizing

| Specific Surface Area of $CaCO_3$ Fillers (m$^2$/g) | Polymer Treatment Level (%) | HST (sec) (filler in sheet) 8% | 16% | 24% |
|---|---|---|---|---|
| 5.9 | 0.0 | 322 | 246 | 38 |
| | 0.5 | 354 | 440 | 626 |
| | 1.0 | 413 | 542 | 807 |
| 7.2 | 0.0 | 219 | 114 | 6 |
| | 0.5 | 287 | 411 | 556 |
| | 1.0 | 316 | 484 | 779 |
| 8.7 | 0.0 | 147 | 5 | 1 |
| | 0.5 | 234 | 226 | 44 |

TABLE II-continued

Effect of Surface Area and Polymer Treatment Level on Sizing

| Specific Surface Area of $CaCO_3$ Fillers ($m^2/g$) | Polymer Treatment Level (%) | HST (sec) (filler in sheet) 8% | 16% | 24% |
|---|---|---|---|---|
| | 1.0 | 301 | 473 | 871 |
| 10.8 | 0.0 | 117 | 8 | 1 |
| | 0.5 | 214 | 215 | 36 |
| | 1.0 | 259 | 430 | 442 |
| 22.7 | 0.0 | 101 | 4 | 1 |
| | 0.5 | 184 | 33 | 2 |
| | 1.0 | 239 | 140 | 11 |

Blanks (no filler) = 1876 seconds
0.25% AKD added to furnish

TABLE III

Drainage/Retention Data on Polymer Treated $CaCO_3$

| | 16% Filler In Pad: Drainage Rate (cc/sec)[a]/Sheet Dryness (%)[b] | First Pass Filler Retention % |
|---|---|---|
| Unfilled Sheet | 112/19.8 | — |
| PCC | 87/22.2 | 72.0 |
| PCC-modified with 0.5% polymer | 91/22.5 | 77.4 |
| PCC-modified with 1.0% polymer | 94/22.7 | 76.4 |

[a]Confidence Level (C.L.) @ ± cc/sec
[b]C.L. @ ± 0.2%

TABLE IV

PHYSICAL PROPERTIES OF FILLERS

| | Morphology | Average Particle Size (μm) | Specific Surface Area ($m^2/g$) | Dry Brightness (%) | Zeta Potential (mV) |
|---|---|---|---|---|---|
| Untreated PCC | Scalenohedral | 1.2-1.4 | 10-12 | 99.7 | +10.0-+15.0 |
| 0.5 Wt. % Cationic Polymer-modified PCC | Scalenohedral | 1.2-1.4 | 10-12 | 98.6 | +20.0-+25.0 |
| 1.0 Wt. % Cationic Polymer-modified PCC | Scalenohedral | 1.2-1.4 | 10-12 | 98.5 | +26.0-+31.0 |
| Untreated FGL | Ground | 2.0 | 5.9 | 98.4 | −23.1 |

TABLE V

Retention Results from Mill Trial

| | Untreated Commercial PCC | 1.5 Wt. % Cationic Polymer-Modified PCC |
|---|---|---|
| Total Retention (%) | 78.3 | 80.7 |
| First-Pass Filler Retention (%) | 50.0 | 56.1 |
| % Filler (felt side) | 22.7 | 18.6 |
| % Filler (wire side) | 19.4 | 17.7 |

TABLE VI

Physical Properties from Mill Trial

| | Untreated Commercial PCC | 1.5 Wt. % Cationic Polymer-Modified PCC |
|---|---|---|
| Basis Weight (lb/3300 $ft^2$) | 39.0 | 40.1 |
| PCC (%) | 15.7 | 15.0 |
| $TiO_2$ (%) | 0.8 | 0.6 |
| Total Filler (%) | 16.5 | 15.6 |
| Corrected Opacity (%) | 88.3 | 88.2 |
| Machine Direction Breaking Length (km) | 7.77 | 8.50 |
| Hercules Size Test (sec.) | 11 | 40 |

TABLE VII

Fugitive Sizing Results from Mill Trial (Reel No. 6 and 10)

| | Untreated Commercial PCC | 1.5 Wt. % Cationic Polymer-Modified PCC |
|---|---|---|
| Hercules Size Test (sec) (initial testing) | 9 | 37 |
| Hercules Size Test (sec) (35 days later) | 7 | 36 |
| Percent Change in Sizing (%) | −22 | −3 |

TABLE VIII

Coefficient of Friction (COF) on Surface of Paper from Mill Trial

| | Untreated Commercial PCC | 1.5 Wt. % Cationic Polymer-Modified PCC |
|---|---|---|
| COF* (static) | .308 | .385 |
| COF* (dynamic) | .214 | .281 |

*results reported as $\frac{\text{grams force}}{\text{sled weight (grams)}}$
Contact: felt-to-wire side

I claim:

1. A method for improving papermaking by accomplishing at least one of the results of reducing the amount of sizing required; maintaining the sizing content over time; improving the handling properties of a formed paper web, including water release; improving the physical properties of the resulting paper, including filler retention, filler distribution, tensile strength, and surface coefficient of friction; and improving the optical properties of the resulting paper, including brightness, opacity, and pigment scattering coefficient, the method comprising adding to a papermaking furnish from about 5 to about 50 weight percent of a filler material which has been surface-treated with from about 0.1 to about 10.0 weight percent, based on the dry weight of filler material, of a cationic polymer, which is a dimer of the general formula

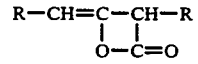

where R is a hydrocarbon group selected from the group consisting of alkyl with at least 8 carbon atoms, cycloalkyl with at least 6 carbon atoms, aryl, aralkyl and alkaryl, which has been made cationic by treatment with at least one of a polyamino-amide and a polyamine polymer, both of which have been reacted with an epoxidized halohydrin compound, to form tertiary and quaternary amine groups on the dimer surface.

2. The method according to claim 1 wherein the filler material is finely divided calcium carbonate from natural limestone or precipitated calcium carbonate.

* * * * *